US005238587A

United States Patent [19]

Smith et al.

[11] Patent Number: 5,238,587

[45] Date of Patent: Aug. 24, 1993

[54] DRY-CLEANING KIT FOR IN-DRYER USE

[75] Inventors: James A. Smith, Chatham, Mass.; George W. Kellett, Cranford; Bonnie Johanning, Clifton, both of N.J.

[73] Assignee: Creative Products Resource Associates, Ltd., North Caldwell, N.J.

[21] Appl. No.: 882,940

[22] Filed: May 14, 1992

Related U.S. Application Data

[63] Continuation-in-part of Ser. No. 672,364, Mar. 20, 1991, abandoned.

[51] Int. Cl.[5] ..... D06M 10/08

[52] U.S. Cl. ..... 252/8.6; 252/8.7; 252/8.8; 252/90; 252/91

[58] Field of Search ..... 252/90, 91, 163, 164, 252/165, 174, 8.6, 8.9

[56] References Cited

U.S. PATENT DOCUMENTS

| | | | |
|---|---|---|---|
| Re. 28,969 | 9/1976 | Naito | 150/3 |
| 375,652 | 12/1887 | Scott | 8/142 |
| 1,885,133 | 11/1932 | Oppenheimer | 252/91 |
| 2,102,858 | 12/1937 | Schlumbohm | 206/46 |
| 2,316,386 | 4/1943 | Albrecht | 8/142 |
| 2,560,649 | 7/1951 | Hornaday | 15/208 |
| 3,151,345 | 10/1964 | Massop | 8/150 |
| 3,686,125 | 8/1972 | Miller | 252/90 |
| 3,813,221 | 5/1974 | Stubits | 8/142 |
| 3,816,321 | 6/1974 | Kleinschmidt | 252/134 |
| 3,827,857 | 8/1974 | Boulus | 8/137 |
| 3,933,425 | 1/1976 | Grunewalder et al. | 8/142 |
| 3,936,538 | 2/1976 | Marshall et al. | 427/242 |
| 3,945,936 | 3/1976 | Lucas et al. | 252/95 |
| 3,989,638 | 11/1976 | Bradley et al. | 252/186 |
| 4,011,172 | 3/1977 | Marsan et al. | 252/187 R |
| 4,017,411 | 4/1977 | Diehl et al. | 252/186 |
| 4,170,565 | 10/1979 | Flesher et al. | 252/93 |
| 4,188,304 | 2/1980 | Clarke et al. | 252/93 |
| 4,239,639 | 12/1980 | Gilbert et al. | 252/90 |
| 4,242,377 | 12/1980 | Roberts et al. | 427/242 |
| 4,289,815 | 9/1981 | Lee | 428/35 |
| 4,336,024 | 6/1982 | Denissenko et al. | 8/142 |
| 4,362,638 | 12/1982 | Caskey et al. | 252/90 |
| 4,374,035 | 2/1983 | Bossu | 252/91 |
| 4,613,446 | 9/1986 | Magyar | 252/91 |
| 4,740,326 | 4/1988 | Hortel et al. | 252/90 |
| 4,764,289 | 8/1988 | Trinh | 252/8.6 |
| 4,797,221 | 1/1989 | Gueldenzopf | 252/95 |
| 4,820,435 | 4/1989 | Zafiroglu | 252/90 |
| 4,824,582 | 4/1989 | Nayar | 252/8.75 |
| 4,834,900 | 5/1989 | Soldanski et al. | 252/88 |
| 4,839,076 | 6/1989 | Willman et al. | 252/90 |
| 4,946,617 | 8/1990 | Sheridan et al. | 252/91 |
| 5,055,215 | 10/1991 | Mains et al. | 252/90 |
| 5,062,473 | 11/1991 | Kellet | 252/8.75 |
| 5,066,413 | 11/1991 | Kellet | 252/8.75 |
| 5,077,114 | 12/1991 | Wraige | 428/190 |
| 5,145,595 | 9/1992 | Morris et al. | 252/91 |
| 5,173,200 | 12/1992 | Kellett | 252/8.8 |

*Primary Examiner*—Paul Lieberman
*Assistant Examiner*—Michael Tierney
*Attorney, Agent, or Firm*—Merchant, Gould, Smith, Edell, Welter & Schmidt

[57] ABSTRACT

A method for cleaning soiled fabric articles is provided which comprises tumbling the soiled articles in a rotary clothes dryer at an elevated temperature, in a closed system, such as a sealed plastic bag, wherein said system also includes a fabric-cleaning article comprising a porous substrate sheet impregnated with a gelled liquid cleaning composition.

31 Claims, No Drawings

DRY-CLEANING KIT FOR IN-DRYER USE

CROSS-REFERENCE TO RELATED APPLICATION

This application is a continuation-in-part of U.S. application Ser. No. 7/672,364, filed Mar. 20, 1991 abandoned.

FIELD OF THE INVENTION

The present invention relates to a laundry-cleaning sheet comprising a gelled solvent-based dry-cleaning composition and a method for use of the cleaning sheet in kit form. The invention particularly relates to a method for use of the dry-cleaning kit to freshen and/or dry-clean spotted or stained fabrics such as clothes. More particularly, the present invention relates to such a method of dry cleaning that can be carried out in the home in a rotary clothes dryer.

BACKGROUND OF THE INVENTION

Methods for dry-cleaning fabrics commonly employ organic solvents which can readily dissolve or disperse soils such as water-insoluble substances, including greases, oily dirts and the like, and which exhibit low solvent boiling points, enabling easy recovery of the solvents.

The use of solvent-based dry-cleaning methods has, however, been primarily limited to commercial cleaning operations which employ expensive specialized equipment. Such equipment includes stills with condensers to contain vapors from the cleaning solvents, which are often toxic. As a result, to utilize such dry-cleaning processes, particularly to remove water-insoluble spots and/or stains from clothes, the user must bring the clothes to a specialized dry-cleaning establishment and pick up the cleaned clothes at a later date. This results in inconvenient expenditures of time in going to the dry-cleaner, waiting for the clothes to be properly cleaned, picking up the clothes, and dealing with damaged and lost articles of clothing. Moreover, articles of clothing from many different people are dry-cleaned with the same batch of solvent, which can result in malodorous residues.

A process for home dry-cleaning clothing is disclosed by S. Denissenko et al. in U.S. Pat. No. 4,336,024, wherein the soiled areas are pre-treated with a liquid cleaning composition. The clothing is then attached to an absorbent sheet and spun using the spin cycle of a washing machine, so that the cleaning composition and the soil are driven through the clothing and into the absorbent sheet. It is also disclosed that the absorbent sheet can be integrally sealed onto a plastic sheet, so that the clothing can be enclosed by the sheet while it is spun in a washing machine. See Col. 11, line 28 to Col. 12, line 40 and claim 1.

It is therefore an object of the invention to provide a solvent-based dry-cleaning composition and a method of use therefor which can be conducted at home without having to take soiled or stale-smelling clothes to commercial cleaning establishments and incurring such inconveniences and disadvantages mentioned above. Additional objects of the present invention will become readily apparent to persons skilled in the art from the following discussion.

SUMMARY OF THE INVENTION

The present invention provides a composite fabric-cleaning article which comprises a coating of a gelled liquid dry-cleaning composition on a flexible support sheet. Soiled fabrics can be cleaned with the coated sheet by applying it to the fabrics under conditions of pressure, i.e., by manual application. However, in a preferred aspect of the invention, there is provided a method for use of the fabric-cleaning sheet in kit form so that the cleaning conveniently and advantageously can be carried out in a rotary hot air clothes dryer.

In one embodiment of the invention, there is provided a composite dry-cleaning sheet comprising a carrier sheet which is coated with a gelled dry-cleaning composition comprising (a) an effective amount of a gelling agent; (b) a liquid vehicle selected from the group consisting of water, a water-miscible organic solvent and mixtures thereof; and (c) at least one surfactant. The gelled cleaning composition can also contain a minor amount of an inorganic salt which is effective to inhibit the transfer of the gelling agent to the soiled fabric, i.e., which inhibits deposition of a visible residue on the fabric article to be cleaned.

In another embodiment of the invention, there is provided a dry-cleaning kit for use of the present fabric-cleaning sheet. This kit comprises (a) the aforesaid composite dry-cleaning sheet and (b) a sealable bag for containment of the cleaning sheet which will not be substantially damaged upon exposure to agitation and to a temperature effective to cause release of the dry-cleaning coating composition from the cleaning sheet in an amount effective to clean soiled fabric articles.

In still a further embodiment of the invention, there is provided a method for cleaning soiled fabric articles comprising (a) placing a soiled, i.e., spotted and/or stained fabric article in the containment bag of the aforesaid dry-cleaning kit which also contains the composite cleaning sheet; (b) sealing the bag; and (c) tumbling the sealed bag and its contents in a dryer at a temperature effective to release the dry-cleaning composition in liquid and/or vapor form and for a time effective to contact an effective amount of said released dry-cleaning composition with said soiled fabric, so as to clean said fabric. Preferably, the spotted and/or stained areas of the fabric are manually rubbed with the dry-cleaning sheet prior to enclosure of the sheet and the fabric in the bag, in order to pre-treat the soiled areas with the dry-cleaning composition, to loosen the soil.

The term "fabrics" or "fabric articles" encompasses not only clothing, but other items which are commonly dry-cleaned, including sheets, draperies, rugs, upholstery coverings, towels and the like. As used herein, the term "dryer" refers to a rotary hot air dryer, which tumbles the clothes in a drum with warm or heated air at an elevated temperature, usually at a temperature of about 40°-95° C., preferably at about 50°-90° C., e.g., for about 15-45 min.

As used herein with respect to the fabrics to be dry-cleaned, the term "soil" includes odoriferous compounds such as tobacco smoke, residue, perfume, mustiness, perspiration and the like, as well as visible spots and stains. Therefore, as used herein, the term "dry cleaning" or "cleaning" includes the removal of both kinds of "soil".

The present invention, including the above-described embodiments and preferred versions thereof is more fully described in the following detailed discussion, wherein all percentages are by weight of the cleaning composition, unless otherwise noted.

DETAILED DISCUSSION OF THE INVENTION

The porous sheets useful as substrates in the present invention may be formed from any fibrous or cellular flexible material which exhibits sufficient thermal stability for use in the dryer, and which can retain sufficient amounts of the gelled cleaning composition to effectively clean fabric without significant leaking or bleeding of the composition during storage. Such sheets include sheets of woven and nonwoven synthetic and natural fibers, felt, paper, or foam, such as hydrophilic polyurethane foam.

Preferably, conventional sheets of non-woven materials are used as substrates herein. Non-wovens are generally defined as adhesively bonded fibrous products having a web or corded fiber structure, or those which comprise fibrous mats in which the fibers are distributed haphazardly or in a random array. The fibers can be natural, such as wool, silk, jute, hemp, cotton, linen, sisal, or ramie; or synthetic such as rayon, cellulose ester, polyvinyl derivatives, polyolefins, polyamides or polyesters. Generally, any diameter or dernier of fiber is useful in the present invention. The non-woven cloth substrates employed herein are not prone to tear or separate when used, for example, in an automatic dryer, due to the haphazard or random array of fibers in the non-woven material which impart excellent strength in all directions. Some examples of preferred non-woven cloth material useful as substrates in the present invention include 100% rayon sheets, known as Fabray® Nonwoven Fabric F-110 (40 gm), available from Sterns Technical Textile Co., or as Brand #6129 from Scott Nonwovens; or 100% polypropylene sheets, known as NW-161, available from Kimberly Clark Co., Neenah, Wis.

Preferred substrates for use in the dry-cleaning sheets of this invention have dimensions ranging from about 3"×4" up to about 14"×16". However, the substrate must also be of a sufficient size to carry a desirable load of solvent-based dry-cleaning composition. For these reasons, the most preferred size of substrates for use in the present invention range from about 4"×14", particularly from about 5"×12" to about 9"×10".

In conjunction with the substrate dimensions, the preferred dry-cleaning sheets of the present invention have surface areas ranging from about 12 $in^2$ to about 224 $in^2$, and most preferably from about 48 $in^2$ to about 120 $in^2$.

The gelled dry-cleaning composition of the invention is prepared by simply mixing in the desired proportions a gelling agent, water, a dry-cleaning solvent, a surfactant and, optionally, an alkali metal salt, stirring the mixture until a gellable homogeneous composition forms. Preferably, the gelling agent is added to the water in a suitable vessel with agitation and the application of external heating. At about 75°-85° C., the solvent, surfactants and any other adjuvants, such as fragrance and preservative, are added sequentially with continuous agitation.

The gellable mixture can then be coated warm onto the substrate by means of a Meyer rod, a floating knife or doctor blade. Alternatively, the substrate can be dipped into the liquid mixture or the mixture can be sprayed or sponged onto the substrate and then allowed to gel. For example, the substrate can be placed on a level surface, such as on a glass plate. The warm dry-cleaning reaction mixture is poured across the top of the substrate and a metal rod is drawn down the surface of the substrate, which will drive the mixture through a non-woven substrate. As the hot fluid contacts the cooler glass surface on the underside of the substrate, it forms a gel which then coats that surface. Therefore, the non-woven substrate is both impregnated with and overcoated with the gelled dry-cleaning composition on at least one side.

Following a cooling period, the finished dry-cleaning sheets are preferably packaged in moisture impermeable packaging, e.g., in foil, a foil-plastic film or a foil-treated paper composite envelope.

Organic Gelling Agent

The present gelled dry-cleaning compositions will include an amount of an organic gelling agent which is effective to gel the liquid dispersions when they are cooled and coated into sheets. Any organic gelling agent or mixture of organic gelling agents can be used which stabilizes the dry-cleaning composition and adheres it to the sheets during manufacture, storage and use, and which yields sheets which distribute the solvent and surfactants while leaving no significant residue on the fabric. Useful gelling agents can include modified starches, modified celluloses (CMC, HPMC), fatty acid salts and polysaccharide gums, i.e., polysaccharide gums that can be gelled in situ by the addition of an effective amount of one or more metal or ammonium cations.

Preferred gums for use in the present invention include vegetable gums, such as the alkali metal salts of alginic acid ("alginates"), carrageenan (preferably kappacarrageenan), pectin, guar gum, and mixtures thereof. These "strong gums" re-gel from solution or dispersion to yield a continuous gel structure.

Other organic gelling agents useful in the practice of the present invention include polyvinylpyrrolidone, polyvinyl alcohol, polyacrylamides and polymeric organic waxes. The useful polymeric waxes include ethylene acrylate copolymers, ethylene acrylic acid copolymers and polyethylene (e.g., oxidized polyethylenes). These materials are commercially available in the form of aqueous emulsions or dispersions, e.g., from Allied Chemical, Morristown, N.J., as the A-C Copolymer and A-C Polyethylene series, such as A-C Copolymer 540, A-C Copolymer 580 and A-C Polyethylene 617 and 629. Waxy polyethylene glycols (PEG) such as those of a molecular weight of about 800 to 1700–2000 are preferred.

Preferred organic gelling agents include the alkali earth metal, alkaline earth metal or ammonium salts of various naturally occurring or synthetic fatty acids. Useful fatty acids may be selected from one or more ($C_8$–$C_{22}$) fatty acids which incorporate 0–3 double bonds per fatty acid molecule, e.g., myristic acid, stearic acid, palmitic acid, lauric acid, behenic acid and the like. Alkali metal salts of fatty acids such as stearic acid are preferred.

Preferably, about 0.25–5% of the gelling agent or agents will be employed in the present dry-cleaning compositions.

Organic Solvent

The present dry-cleaning compositions are formed by dispersing the gelling agent in a solvent system which can comprise an organic co-solvent or solvent system.

Preferably, the organic solvent or solvent mixture is non-toxic and water-miscible.

Most preferably, the major portion of the organic solvent will be a glycol ether. These materials are lower-(alkoxy)- or lower(alkoxy)lower(alkoxy)-ethers of ethanol or isopropanol. Many glycol ethers are available under the trade names Arcosolv® (Arco Chemical Co.) or Cellosolve®, Carbitol®, or Propasol® (Union Carbide Corp.), and include, e.g., butylCarbitol®, hexylCarbitol®, methylCarbitol®, and Carbitol® itself, (2-(2-ethoxy)ethoxy)ethanol. The choice of glycol ether can be readily made by one of skill in the art on the basis of its volatility, water-solubility, wt-% of the total dispersion and the like. Pyrrolidinone solvents such as N-methyl-2-pyrrolidinone (M-Pyrol®) or 2-pyrrolidone (2-Pyrol®) can also be used.

Alcohols which can be employed as co-solvents in the present invention include liquid polyethylene glycols, i.e., polyethylene glycol-200, 300, 400 or 600, wherein the suffixed numbers indicate the approximate molecular weight of the glycol. Other useful co-solvents include other alcohols, for example: (a) lower(alkanols), such as ethanol, isopropanol, and n-butanol; (b) ketones such as acetone and methyl ethyl ketone; (c) $C_2$–$C_4$ polyols, such as a diol or triol, e.g., ethylene glycol, propylene glyol, glycerol or mixtures thereof or (d) hydrocarbon solvents such as isoparaffinic solvents (Isopar K).

Other organic solvents can also be used, including conventional chlorinated dry-cleaning solvents. Preferred examples of these solvents comprise the di- to tetrachlorinated derivatives of methane, the di- to pentachlorinated derivatives of ethane and of ethylene, the mono- to trichlorinated derivatives of cyclohexane, and monochlorobenzene. Specific examples of this type include carbon tetrachloride, methylene chloride, 1,1-dichloroethane, 1,2-dichloroethane, 1,1-trichloroethane, 1,1,2-trichloroethane, 1,1,1-trichloroethane, 1,1,2-trichloroethane, trichloroethylene, 1,1,2,2-tetrachloroethane, tetrachloroethylene, pentachloroethane, monochlorocyclohexane, 1,4-dichlorocyclohexane, monochlorobenzene and mixtures of the foregoing.

The solvent is present in the dry-cleaning composition in an amount from about 2 to about 32 weight percent, more preferably in an amount of from about 5 to about 25 weight and more preferably from about 7.5 to about 15 weight percent.

Surfactant

Also employed in the dry-cleaning composition of the invention are minor but effective amounts of one or more surfactants, which act as cleaning intensifiers to facilitate removal of the soil upon release of the dry-cleaning composition in the dryer. Surfactants are useful in the dry-cleaning composition at from about 5–10 weight percent, and more preferably from about 3–7 weight percent.

Nonionic surfactants and amphoteric surfactants are preferred for use in the present invention and can also act as adjunct fabric softeners. Minor but effective amounts of certain anionic surfactants may also be useful in the present invention to provide faster dissipation of the composition in the dryer.

Nonionic surfactants include the condensation products of ethylene oxide with a hydrophobic polyoxyalkylene base formed by the condensation of propylene oxide with propylene glycol. The hydrophobic portion of these compounds has a molecular weight sufficiently high so as to render it water-insoluble. The addition of polyoxyethylene moieties to this hydrophobic portion increases the water-solubility of the molecule as a whole, and the liquid character of the product is retained up to the point where the polyoxyethylene content is about 50% of the total weight of the condensation product. Examples of compounds of this type include certain of the commercially-available Pluronic® surfactants (BASF Wyandotte Corp.), especially those in which the polyoxypropylene ether has a molecular weight of about 1500–3000 and the polyoxyethylene content is about 35–55% of the molecule by weight, i.e., Pluronic® L-62.

Preferred nonionic surfactants include the condensation products of $C_8$–$C_{22}$ alkyl alcohols with 2–50 moles of ethylene oxide per mole of alcohol. Examples of compounds of this type include the condensation products of $C_{11}$–$C_{15}$ fatty alcohols with 3–50 moles of ethylene oxide per mole of alcohol which are commercially available from Shell Chemical Co., Houston, Tex, as, i.e., Neodol® 23–6.5 ($C_{12}$14 $C_{13}$ fatty alcohol condensed with about 7 moles of ethylene oxide), the Poly-Tergent® SLF series from Olin Chemicals or the Tergitol® series from Union Carbide, i.e., Tergitol® 15-S-15, which is formed by condensing about 15 moles of ethylene oxide with a $C_{11}$–$C_{15}$ secondary alkanol; Tergitol® TMN-6, which is the condensation product of about 6 moles of ethylene oxide with isolauryl alcohol (CTFA name: isolaureth-6), Incropol® CS-12, which is a mixture of stearyl and cetyl alcohol condensed with about 12 moles of ethylene oxide (Croda, Inc.), Incropol® L-7, which is lauryl alcohol condensed with about 7 moles of ethylene oxide (Croda, Inc.), and Tergitol® 15-S-3, which is the condensation product of about 3 moles of ethylene oxide with a mixture of ($C_{11}$–$C_{15}$) secondary alcohols.

Preferred nonionic surfactants also include ($C_8$–$C_{24}$) fatty acid amides, e.g., the monoamides of a mixture of arachidic and behenic acid (Kenamide® B, Humko Chem. Co., Memphis, Tenn.), and the mono- or dialkanolamides of ($C_8$–$C_{22}$) fatty acids, e.g., the diethanol amide, monoethanol amide or monoisopropanolamide of coconut, lauric, myristic or stearic acid, or mixtures thereof. For example, Monamide® S is the monoethanol amide of stearic acid (Mona Industries, Inc., Patterson, N.J.), and Monamine ALX-100S (Mona Industries), is a mixture of the diethanol amide of cocoa fatty acid and the diethanol amide of dodecylbenzene sulfonic acid. The fatty alkanolamide designated "Active #2" (Blew Chem. Co.) is also believed to be of this class of nonionic surfactant.

Other nonionic surfactants which may be employed include the ethylene oxide esters of $C_6$–$C_{12}$ alkyl phenols such as (nonylphenoxy)polyoxyethylene ether. Particularly useful are the esters prepared by condensing about 8–12 moles of ethylene oxide with nonylphenol, i.e., the Igepal® CO series (GAF Corp., New York, N.Y.).

Other useful nonionics include the ethylene oxide esters of alkyl mercaptans such as dodecyl mercaptan polyoxyethylene thioether, the ethylene oxide esters of fatty acids such as the lauric ester of polyethylene glycol and the lauric ester of methoxypolyethylene glycol, the ethylene oxide ethers of fatty acid amides, the condensation products of ethylene oxide with partial fatty acid esters of sorbitol such as the lauric ester of sorbitan polyethylene glycol ether, and other similar materials, wherein the mole ratio of ethylene oxide to the acid, phenol, amide or alcohol is about 5–50:1.

Useful amphoteric surfactants include the ($C_8$–$C_{22}$) alkyl(dimethyl)amine oxides, such as those of the Schercamox ® series (Scher Chem. Co., Clifton, N.J.), e.g., Schercamox DML is lauryl(dimethyl)amine oxide. Other useful amphoteric surfactants are known to the art, e.g., as disclosed in Marshall et al. (U.S. Pat. No. 3,936,538), the disclosure of which is incorporated by reference herein.

Useful anionic surfactants are known to the art, including sodium cocoyl isethionate, commercially available as Jordapon ® CI from Mazer Chemicals, Gurnee, Ill. The anonionic surfactant may be optionally added in minor but effective amounts, e.g., up to about 1%, in addition to the nonionic or amphoteric surfactant.

One broad class of cationic surfactants is referred to as quaternary amines, or "quats." These materials can also function to condition the fabrics and to reduce static cling and lint adherence: Subclasses of these materials are referred to by the art as monomethyl trialkyl quaternaries, imidazolinium quaternaries, dimethyl alkyl benzyl quaternaries, dialkyl dimethyl quaternaries, methyl dialkoxy alkyl quaternaries, diamido amine-based quaternaries and dialkyl methyl benzyl quaternaries wherein the "alkyl" moiety is preferably a ($C_8$–$C_{24}$)alkyl group and the quaternary(amine) is a chloride or methosulfate salt.

For convenience, one subclass of aliphatic quaternary amines may be structurally defined as follows:

$$(R)(R_1)(R_2)(R_3)N^+X^-$$

wherein R is benzyl, or lower(alkyl) benzyl; $R_1$ is alkyl of 10 to 24, preferably 12 to 22 carbon atoms; $R_2$ is $C_{10}$–$C_{24}$-alkyl, $C_1$–$C_4$-alkyl, or ($C_2$–$C_3$)hydroxyalkyl, $R_3$ is $C_1$–$C_4$-alkyl or ($C_2$–$C_3$)hydroxyalkyl and X represents an anion capable of imparting water solubility or dispersibility including chloride, bromide, iodide, sulfate and methosulfate. Particularly preferred species of these aliphatic quats include n-$C_{12}$–$C_{18}$-alkyl-dimethylbenzylammonium chloride (myrisalkonium chloride), n-$C_{12}$–$C_{14}$-alkyldimethyl(ethylbenzyl)ammonium chloride (quaternium 14), dimethyl-(benzyl)ammonium chloride and mixtures thereof. These compounds are commercially available as the BTC series from Onyx Chemical Co., Jersey City, N.J. For example, BTC 2125M is a mixture of myrisalkonium chloride and quaternium-14. Dihydrogenated tallow methyl benzyl ammonium chloride is available as Variquat ® B-343 from Sherex Chem. Co., Dublin, Ohio. This class of quat is germicidal, and is preferably used in combination with at least one of the other quats disclosed hereinbelow.

Other useful aliphatic quats include those wherein both R and $R_1$ are ($C_8$–$C_{24}$)alkyl, e.g., the N,N-di-(higher)$C_{10}$–$C_{24}$-alkyl-N,N-di(lower)-$C_1$–$C_4$(alkyl)-quaternary ammonium salts such as distearyl(dimethyl)ammonium chloride, dihydrogenated tallow(dimethyl)ammonium chloride, ditallow(dimethyl)ammonium chloride (Arquad ® 2HT-75, Akzo Chemie, McCook, Ill.), distearyl(dimethyl)ammonium methylsulfate and dihydrogenated-tallow(dimethyl)ammonium methyl sulfate (Varisoft ® 137, Sherex).

Other useful quaternary ammonium antistatic agents include the acid salts of (higher(alkyl)-amido(lower)alkyl)-(dialkyl)-amines of the general formula:

$$[(A(C{=}O)—Y—)—N(R_1)(R_2)(R_3)]^+X^-$$

wherein A is a $C_{14}$–$C_{24}$ normal or branched alkyl group, Y is ethylene, propylene or butylene, $R_1$ and $R_2$ are individually H, $C_1$–$C_4$(lower)alkyl or ($C_1$–$C_3$)hydroxyalkyl or together form the moiety —$CH_2$—$CH_2YCH_2$—$CH_2$—, wherein Y is NH, O or $CH_2$; $R_3$ is the same as $R_1$ or is also [A(C=O)Y—], and X is the salt of an organic acid. Compounds of this class are commercially available from Croda, Inc., New York, N.Y., as the Incromate ® series, e.g. Incromate ® IDL [isostearamidopropyl(dimethyl)amine lactate], Incromate ® ISML [isostearamidopropy(morpholinium)lactate] and Incromate ® CDP [cocamidopropyl(dimethyl)amine propionate]. Ditallowdiamido methosulfate (quaternium 53) is available from Croda as Incrosoft ® T-75.

Preferred imidazolinium salts include: (methyl-1-tallow-amido)ethyl-2-tallow imidazolinium methyl sulfate; available commercially from Sherex Chemical Co. as Varisoft ® 475; (methyl-1-oleylamido)ethyl-2-oleylimidazolinium methyl sulfate; available commercially from Sherex Chemical Co. as Varisoft ® 3690, tallow imidazolinium methosulfate (Incrosoft ® S-75, Croda) and alkylimidazolinium methosulfate (Incrosoft ® CFI-75, Croda).

Other useful amine salts are the stearyl amine salts that are soluble in water such as stearyl-dimethylamine hydrochloride, distearyl amine hydrochloride, decyl pyridinium bromide, the pyridinium chloride derivative of the acetylaminoethyl esters of lauric acid, lauryl trimethyl ammonium chloride, decylamine acetate and bis[(oleoyl)-(5,8)-ethanoloxy]-tallow($C_{14}$–$C_{18}$)aminehydrogen phosphate (Necon ® CPS-100) and the like.

Water

Depending upon the nature of the other components present in the dry-cleaning composition and their respective amounts, when water is present, the water content of the composition can range from about 40–95 weight percent, preferably from about 60–90 weight percent and most preferably from about 75–87.5 weight percent. Generally, sufficient water is employed to completely disperse the gelling agent and other components to insure the preparation of a gelled homogeneous dry-cleaning composition upon cooling, and also to aid in the removal of water-based stains.

Inorganic Salt

Under some circumstances, such as when carrageenans are employed as the gelling agent(s), application of the coated sheet to the fabric to be cleaned, can deposit a white residue on the fabric. Therefore, particularly when colored fabrics are to be treated, it is preferred to incorporate a minor but effective amount of a metal salt, such as a metal halide, into the gelled liquid cleaning composition. Alkali metal or alkaline earth metal salts are preferred for this purpose, most preferably potassium, sodium, lithium or calcium chloride is used. The salt is effective at very low levels, e.g. at about 0.0025–0.1% by weight of the gelled liquid cleaning composition.

Optionally, a fragrance, deodorant, preservative, insect repellant (moth-proofing agent), and/or coloring agent may be present in the gelled dry-cleaning composition, along with any of a number of finishing agents, fumigants, lubricants, fungicides and sizing agents, as long as such additives do not interfere with the dispersal and spot and/or stain removal properties of the composition. The amounts of these additives will generally comprise from about 0.25% to about 5% by weight of the total dry-cleaning composition. Organic fragrances, such as oil of cedar, which can also perform an insect repellant function, are preferred.

In a preferred embodiment of the invention, a composite dry-cleaning sheet comprising a substrate coated and impregnated with the gelled dry-cleaning composition of the invention is provided in kit form with a bag for containment of the cleaning sheet. The soiled fabric (or fabrics) is added to the bag along with the dry-cleaning sheet and the thus-enclosed fabric and sheet are tumbled in an automatic dryer, which provides an amount of friction and heat effective to cause release of the dry-cleaning composition in liquid and/or in vaporous form from the cleaning sheet. The solvent contacts spotted and/or stained portions of fabric being treated and removes spots and/or stains. The time elapsed in contacting the soiled areas will, of course, influence the extent of the removal of substances responsible for soiling the fabric.

In order to effectively contain the vaporous dry-cleaning compositions to within the confines of the sealed bag, the bag must, of course, be fabricated of an essentially gas impermeable material and comprise an opening which can be reversably closed. For example, the bag can be formed from polyethylene, polypropylene, polyamide or a multi-ply or layer complex comprising such materials. It is also important that the containment bag will not substantially be damaged upon exposure to conditions including a temperature effective to cause release of the dry-cleaning composition from the sheet.

After use, the bag may be discarded, or if desired, it may be constructed of a suitable material to provide it with repeated usage in a plurality of cleaning cycles.

The bags can also be formed with one or more separate compartments for dry-cleaning strips of differing composition in accordance with the invention, depending upon the nature of substances soiling the garment or fabric article to be treated.

To use the dry-cleaning strip of the present invention in kit form, a spotted and/or stained fabric article is preferably pretreated by rubbing it with the cleaning sheet, then it is placed inside the containment bag with the dry-cleaning sheet. The bag is then sealed, e.g., by means of clips, a zip-lock-type fastener, a zipper, a Velcro® strip, press studs, or a re-sealable adhesive strip. Zip-lock-type fasteners are disclosed in the U.S. Pat. No. Re 28,969. The sealed bag and its contents are then simply tumbled, for example, in a conventional rotary clothes dryer at a temperature effective to release the dry-cleaning composition from the sheet, and for a time effective to contact an effective amount of the released dry-cleaning composition with the soiled article so as to remove the soil. If necessary, the process may be repeated on the soiled articles any number of times, using a fresh dry-cleaning sheet, to substantially remove all of a particularly difficult soil.

The following examples further illustrate the present invention and preferred embodiments thereof. It is to be understood, however, that these examples are for illustrative purposes only and are not intended to limit the scope of the specification or claims thereof in any way.

EXAMPLE I: DRY-CLEANING SHEET

A 250 ml beaker was charged with 83 ml distilled water, and 1.95 g of powdered gum carrageenan (Satiagel GS-500, Colony Import & Export Co., Garden City, N.Y.) was added with stirring. The stirred mixture was heated to 80° C., at which point 9.75 g of 2-(2-ethoxyethoxy)ethanol was added, followed, sequentially at five minute intervals, by the addition of 1.87 g Monamine ALX-100S (cocamide DEA and DEA dodecylbenzene sulfonate, Mona Industries, Inc.), 0.63 g of Tergitol 15-S-3 ($(C_{11-15}H_{23-31})O(CH_2CH_2O)_3H$, Union Carbide Chemicals, Danbury, Conn.), 2.0 g Schercamox DML (Lauramine Oxide, Scher Chemicals, Inc., Clifton, N.J.), 0.53 g of preservative (Nuosept 95, Nuodea, Inc., Piscataway, N.J.) and 0.5 g of fragrance. After 5 min, a line of the homogeneous warm mixture was poured along one edge of a 9.5"×9.5" Rayon non-woven sheet (Scott Paper Co.) which had been attached to a glass plate. A metal rod was used to spread the reaction mixture evenly across the sheet. Upon cooling, a finished dry-cleaning sheet was obtained which was impregnated and stably coated with a gelled dry-cleaning composition. The dry-cleaning sheet was folded and packaged in a plastic-lined foiled packet.

EXAMPLE II: DRY-CLEANING KIT

A dry-cleaning sheet was prepared as disclosed in Example I, but using 85 g of water and omitting the Schercamox DML surfactant and the fragrance. To evaluate the ability of the resultant sheet to clean soiled fabrics, two inch diameter stains were made on swatches of various materials with beef gravy, spaghetti sauce, lipstick and foundation. The stains were allowed to age at 25° C. for 24 hr. The stained fabrics were evaluated visually, and one swatch of each stain was retained as a control (visual stain rating = 10).

The swatches were held individually against a folded paper towel and the stain was dabbed with the dry-cleaning sheet to loosen the dried soil. The pretreated soiled swatch was placed with the dry-cleaning sheet in a Tri-Ex Hot Fill Bag (26"×30"×0.00475"; Union Camp Bag Division Products, Tomah, Wis.), the bag was sealed and the bag and its contents were tumbled in a hot air dryer for 20 minutes on low heat.

The swatches were removed from the bags and visually evaluated after 24 hours. The results of the evaluations are summarized on Table I, which demonstrate the ability of the present kit to effectively remove a variety of stains.

TABLE I

| | Stain Removal By Dry-Cleaning Kit Readings - CPR Visual* | | | |
|---|---|---|---|---|
| Light Material | Beef Gravy | Spaghetti Sauce | Lipstick | Foundation |
| 100% Wool | 1.00 | 1.00 | 1.00 | 1.00 |
| 75% Polyester/ 25% Wool | 1.00 | 1.00 | 1.00 | 1.00 |
| 100% Silk | 1.00 | 1.50 | 1.00 | 1.00 |
| 50% Polyester/ 50% Rayon | 1.00 | 1.00 | 1.00 | 1.00 |
| 100% Rayon | 2.00 | 2.00 | 4.00 | 2.50 |
| TOTAL | 6.00 | 6.50 | 8.00 | 6.50 |

*1 = completely clean; 10 = original stain.

EXAMPLE III. DRY CLEANING COMPOSITION CONTAINING POTASSIUM CHLORIDE (A) A fifty liter mixing vessel was charged with 25.1 liters of distilled water, and 300 g of powdered kappacarrageenan (Galcarin GP-911) was added with stirring. The stirred mixture was heated to 80° C., at which point 2.925 liters of 2-(2-ethoxyethoxy)ethanol was added, followed sequentially at five-minute intervals by 561 g of fatty alkanol amide (Active #2), 189 g of Tergitol 15-S-3; 600 g of Schercamox DML, 159 go f Nuosept 95 and 150 g of fragrance. After five minutes, a line of the homogeneous warm mixture was poured along one edge of a 9.5"×9.5" Rayon non-woven sheet which had been attached to a glass plate. A metal rod was used to spread the reaction mixture evenly across the sheet. Upon cooling, the impregnated sheet was dipped into a 5% aqueous potassium chloride (KCl) solution, removed, and then blotted dry with a paper towel to yield a finished dry cleaning sheet.

(B) The procedure of Example III(A) was followed to form a dry cleaning sheet, with the exception that the dipping step was omitted and 150 ml of 5% aqueous KCl (0.025 wt-% KCl) was added to the reaction mixture following dispersal of the gum.

(C) The procedure of Example III(B) was followed to form a dry cleaning sheet, with the exception that 300 ml of 5% aqueous KCl (0.05 wt-% KCl) was added to the reaction mixture following dispersal of the gum.

A dry cleaning kit was assembled and evaluated as described in Example II. The cleaning results are summarized in Table I, below, wherein C=1 indicates complete removal of the stain, C=10 indicates no removal of the stain, R=5 indicates deposition of a heavy white residue on dark wool fabric and R=1 indicates no visible residue.

TABLE II

| | Stain Removal By Dry-Cleaning Kit Readings - CPR Visual | | | |
|---|---|---|---|---|
| Material/Stain | Control[a] | Ex. III(A) | Ex. III(B) | Ex. III(C) |
| Dark Fabric | | | | |
| 100% Wool/ Spaghetti Sauce | R = 4.0 C = 1.0 | R = 1.0 C = 1.0 | R = 1.0 C = 1.0 | R = 1.0 C = 1.0 |
| 100% Rayon/ No stain | R = 5.0 | R = 2.0 | R = 3.0 | R = 3.0 |
| Light Fabric | | | | |
| 100% Rayon/ Beef gravy | C = 1.0 | C = 1.0 | C = 1.0 | C = 1.0 |
| 100% Silk/ Lipstick | C = 1.0 | C = 1.0 | C = 1.0 | C = 1.0 |
| 75% Polyester/ 25% Wool; Beef gravy | C = 1.0 | C = 1.0 | C = 1.0 | C = 1.0 |

[a]Formula of Example III, no KCl.

The invention has been described with reference to various specific and preferred embodiments and techniques. However, it should be understood that many variations and modifications may be made while remaining within the spirit and scope of the invention.

What is claimed is:

1. A fabric-cleaning article comprising a porous substrate sheet stably impregnated with a gelled cleaning composition consisting essentially of about 40–95% water, about 0.25–5% of a gelling agent, about 2–32% of a water-miscible organic solvent and about 5–10% surfactant.

2. The fabric-cleaning article of claim 1 wherein the organic solvent comprises a glycol ether.

3. The fabric-cleaning article of claim 1 wherein the surfactant includes a least one nonionic surfactant.

4. The fabric-cleaning article of claim 1 wherein the substrate sheet is a non-woven fabric sheet.

5. The fabric-cleaning article of claim 1 wherein the gelling agent is an organic gum.

6. The fabric-cleaning sheet of claim 5 wherein the organic gum is carrageenan.

7. The fabric cleaning sheet of claim 6 wherein the cleaning composition further comprises about 0.0025–0.075% of an alkali metal halide.

8. A fabric-cleaning kit comprising, packaged in association, (a) at least one plastic bag having an opening comprising a fastening system so that the bag can enclose in a vapor-impermeable manner, a soiled fabric, and (b) at least one fabric-cleaning article comprising a porous substrate sheet stably impregnated with a gelled cleaning composition comprising about 40–95% water, about 0.25–5% of a gelling agent, about 2–32% of a water-miscible organic solvent and about 0.5–10% surfactant, wherein said cleaning article is separately packaged in a moisture-impermeable envelope.

9. The kit of claim 8 wherein said fastening system consists of press-studs, clips, a zipper, a Velcro® strip, a Zip-lock® seal or opposed strips of resealable adhesive.

10. The kit of claim 8 wherein said plastic consists of polypropylene, polyethylene or polyamide.

11. The kit of claim 8 wherein the liquid vehicle contains about 60–90% water.

12. The kit of claim 11 wherein the liquid vehicle contains about 5–25% water-miscible organic solvent.

13. The kit of claim 11 wherein the organic solvent includes a glycol ether.

14. The kit of claim 8 wherein the substrate sheet consists of fabric, paper or foam.

15. The kit of claim 14 wherein the gelling agent is an organic gum.

16. The kit of claim 15 wherein the gelling agent is a carrageenan.

17. The kit of claim 15 wherein the gelled cleaning composition comprises about 0.0025–0.1% of an alkali metal salt.

18. The kit of claim 8 wherein the soiled fabric is an article of clothing.

19. A process for cleaning a soiled fabric article with a cleaning composition, said process comprising:

(a) placing said soiled fabric article and a fabric-cleaning article comprising a porous substrate sheet stably impregnated with a gelled cleaning composition comprising about 40–95% water, about 0.25–5% of a gelling agent, about 2–32% of a water-miscible organic solvent and about 0.5–10% surfactant, into a plastic bag;

(b) forming said bag into a closed system comprising said soiled fabric article and said fabric-cleaning article;

(c) tumbling said closed system in a rotary clothes dryer at an elevated temperature, to enable the gelled cleaning composition to contact said soiled article and to disperse said soil; and (d) removing the cleaned fabric article from the closed system.

20. (c) tumbling said closed system in a rotary clothes dryer at an elevated temperature sufficient to dispense the gelled cleaning composition without substantially damaging the bag to enable the gelled cleaning composition to contact said soiled article and to disperse said soil; and

21. The process of claim 19 wherein the tumbling is carried out at about 40°–95° C.

22. The process of claim 21 wherein the tumbling is carried out for about 15–45 minutes.

23. The process of claim 19 wherein, prior to step (a), the soiled fabric article is manually contacted with the fabric-cleaning article to loosen said soil.

24. The process of claim 19 wherein said soiled fabric article is an article of clothing.

25. A composite fabric-cleaning article comprising a flexible porous base sheet, having coated thereon an effective amount of a gelled cleaning composition comprising:

(a) about 60–90% of water;

(b) about 0.25–5% of a gelling agent;

(c) about 5–25% of an organic solvent; and (d) about 0.5–10% of a surfactant; and wherein said composition, when released from said sheet, provides for soil removal from a soiled fabric article when said sheet is applied thereto under conditions of pressure.

26. The fabric cleaning article of claim 25 wherein the gelling agent is carrageenan.

27. The fabric cleaning article of claim 26 wherein the cleaning composition further comprises about 0.0025–0.1% of an alkali metal halide.

28. The fabric cleaning article of claim 27 wherein the halide is KCl.

29. A fabric-cleaning kit comprising:

(a) a composite cleaning article comprising a non-woven fabric sheet having coated thereon an effective amount of a gelled cleaning composition comprising:

(i) about 40–95% water; (ii) about 2–32% of a water-miscible organic solvent; (iii) about 0.25–5% of a gelling agent; and (iv) about 0.5–10% of a surfactant;

wherein said composition, when released from said sheet, provides for stain removal from a stained fabric article; and (b) a separately provided bag adapted for containment of said cleaning article and a soiled article of clothing, wherein said bag comprises a non-porous material which is not substantially damaged upon exposure to agitation and to a temperature effective to cause the release of said composition from said sheet.

30. The fabric cleaning sheet of claim 29 wherein the gelled cleaning composition comprises a minor amount of an alkali metal halide salt which is effective to prevent deposition of a visible residue on the stained fabric article.

31. A method for stain removal from a soiled fabric article, said method comprising the steps of:

(a) placing the soiled fabric article and a composite cleaning article comprising a non-woven fabric sheet having coated thereon a composition comprising about 40–95% water, about 2–32% of a water-miscible organic solvent, about 0.25–5% of a gelling agent, and about 0.5–10% of a surfactant within a bag formed of a non-porous material which is not substantially damaged upon exposure to agitation and to a temperature effective to cause the release of said composition from said sheet;

(b) sealing the bag; and (c) tumbling the sealed bag for a sufficient time and at a sufficient temperature to contact an effective amount of the released cleaning composition with the stained fabric article, so as to clean said fabric article.

* * * * *

UNITED STATES PATENT AND TRADEMARK OFFICE

CERTIFICATE OF CORRECTION

PATENT NO. : 5,238,587

DATED : August 24, 1993

INVENTOR(S) : James A. Smith, George W. Kellett, Bonnie Johanning

It is certified that error appears in the above-identified patent and that said Letters Patent is hereby corrected as shown below:

At column 5, line 54, "from about 5-10" should read "from about 0.5-10"

At column 6, line 21, "$C_{12}$14 $C_{13}$" should read "$C_{12}$ - $C_{13}$"

Claim 1, line 56, delete "about 5-10%" and replace with "about 0.5-10%"

Claim 19, line 52-55, delete sub-element (c) in its entirety and replace with:

> "(c) tumbling said closed system in a rotary clothes dryer at an elevated temperature sufficient to dispense the gelled cleaning composition without substantially damaging the bag to enable the gelled cleaning composition to contact said soiled article and to disperse said soil; and"

UNITED STATES PATENT AND TRADEMARK OFFICE

CERTIFICATE OF CORRECTION

PATENT NO. : 5,238,587

DATED : August 24, 1993

INVENTOR(S) : James A. Smith, George W. Kellett, Bonnie Johanning

It is certified that error appears in the above-identified patent and that said Letters Patent is hereby corrected as shown below:

Claim 20, line 58-63, delete existing claim 20 in its entirety and replace with:

"20. The process of claim 19 wherein the bag is formed into a closed system by closing the opening of said bag with a reversible fastening system."

Signed and Sealed this

Twenty-ninth Day of February, 2000

*Attest:*

Q. TODD DICKINSON

*Attesting Officer*

*Commissioner of Patents and Trademarks*